United States Patent [19]

Larkin

[11] Patent Number: 5,056,946

[45] Date of Patent: Oct. 15, 1991

[54] COMBINATION GOLF CLUB AND GOLF BALL CLEANING SYSTEM

[76] Inventor: Mark Larkin, 419 Northgate, Lindenhurst, Ill. 60646

[21] Appl. No.: 641,312

[22] Filed: Jan. 8, 1991

Related U.S. Application Data

[63] Continuation of Ser. No. 471,559, Jan. 29, 1990, abandoned.

[51] Int. Cl.[5] ..... A63B 47/04

[52] U.S. Cl. ..... 401/11; 273/32 B; 401/186

[58] Field of Search ..... 401/9, 10, 11, 139, 401/186; 206/229; 220/85 H, 85 F; 141/338, 340, 341, 342, 343; 273/32 B

[56] References Cited

U.S. PATENT DOCUMENTS

| | | | |
|---|---|---|---|
| 719,128 | 1/1903 | McGuire | 141/341 X |
| 959,715 | 5/1910 | Carson | 141/340 |
| 2,608,705 | 9/1952 | Duff | 401/11 |
| 2,904,811 | 9/1959 | Rabelow | 401/186 |
| 3,008,612 | 11/1961 | Ganter | 206/229 X |
| 3,087,189 | 4/1963 | Scanlon | 401/11 |
| 3,456,650 | 7/1969 | Schwartzman | 401/186 X |
| 3,923,040 | 12/1975 | Beach | 141/338 X |
| 4,345,704 | 8/1982 | Boughton | 220/85 H X |
| 4,350,457 | 9/1982 | Carnahan | 401/11 X |
| 4,475,838 | 10/1984 | Cropton | 401/86 X |
| 4,627,546 | 12/1986 | Carranza | 220/85 H X |

FOREIGN PATENT DOCUMENTS

| | | | |
|---|---|---|---|
| 245961 | 9/1911 | Fed. Rep. of Germany | 141/343 |
| 311988 | 12/1955 | Switzerland | 141/342 |

*Primary Examiner*—Steven A. Bratlie

*Attorney, Agent, or Firm*—Alan R. Thiele

[57] ABSTRACT

A device for converting a squeeze bottle having a valved brush closure to a golf club and a golf ball cleaning system includes a ring for attaching the device to a flexible squeeze bottle, a combination collar and basin assembly for rotatably positioning golf balls and a strap therebetween.

5 Claims, 2 Drawing Sheets

COMBINATION GOLF CLUB AND GOLF BALL CLEANING SYSTEM

This application is a continuation of application Ser. No. 07/471,559, filed Jan. 29, 1990, now abandoned.

BACKGROUND OF THE INVENTION

The present device relates to combination golf ball and golf club cleaning systems; more particularly, the device of the present invention relates to a device which transforms a squeeze bottle golf club cleaner into a combination golf ball and golf club cleaning system.

In the game of golf it is important to keep both the golf ball and the golf clubs clean. A soiled golf ball will not move smoothly through the air and consequently, a shortened or erratic flight path will result. Likewise, when a dirty golf ball is hit with a putter, its roll over the ground toward the cup will be adversely affected.

A number of golf ball washers are available. Some include donut shaped sponges wherein the golf ball is pushed through a hole in a moistened sponge. Others employ crank type rotary brushes which rotate the ball between moving brushes. Still others draw the golf ball across the surface of stationary brushes. Yet others employ concave sponges which are attached to a squeeze bottle of cleaning fluid. All of these ball washers function satisfactorily but have not been combined with any other device to clean golf clubs. Accordingly, if a golfer is to use clean golf balls and clean golf clubs, he must carry different cleaning devices for each.

Golf clubs, on the other hand, typically include a pattern of grooves on the surface of the club head which strikes the ball. The purpose of these grooves is to impart a spin to the golf ball when it leaves its position of rest. This spin provides better golf ball flight and prevents excessive roll when the golf ball strikes the ground. If the grooves on the golf club become dirty as a result of contact with the ground and if these grooves are not cleaned, the club head will not properly impart a spin to the golf ball.

There are various golf club scrubber devices available. Some of these systems include squeeze bottles of cleaning fluid. While these systems clean golf clubs in a satisfactory manner, they have not adapted for the cleaning of golf balls; consequently, the golfer must carry separate golf ball and golf club cleaning systems. Therefore, there is a need in the art for a single device which cleans both the heads of golf clubs and the outer surface of golf balls.

SUMMARY OF THE INVENTION

The device of the present invention is used with a squeeze bottle of cleaning fluid to clean both the heads of golf clubs and the outer surface of golf balls. It converts available squeeze bottles having a female threaded valved brushed closure to a device for both cleaning golf clubs and golf balls.

The preferred embodiment of the combination golf ball and golf club cleaning system of the present invention consists of three parts. The first part is a circular ring which attaches the device of the present invention to the top of the squeeze bottle. When the female threaded valved brush closure is placed on the externally threaded neck of the squeeze bottle, the ring is secured between shoulder on the top of the squeeze bottle and the bottom of the female threaded closure.

Opposite the ring is the second part of the present invention; a combination collar-basin. The collar is constructed and arranged to fit over and frictionally engage the outside of the valved brush closure. Formed contiguous with the collar is a basin. The basin allows a golf ball to rotate against the ends of the bristles of the valved brush closure.

The third portion of the device is a strap which connects the ring to the combination collar-basin portion. If desired, the strap portion may include an adjustable central guard strap and slot for attaching the combination golf ball and golf club cleaning system of the present invention to a ring on a golf club bag.

BRIEF DESCRIPTION OF THE DRAWINGS

A better understanding of the combination golf club and golf ball cleaning system of the present invention may be had by reference to the attached drawings, wherein.

DESCRIPTION OF THE EMBODIMENTS

Figure 1:
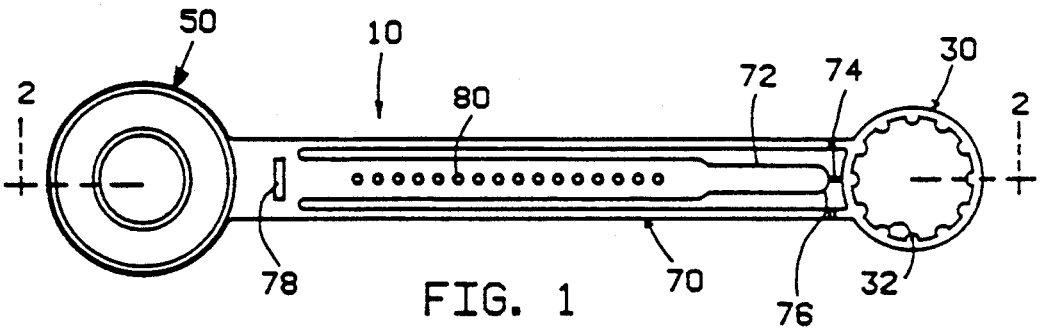
FIG. 1 is a top plan view of the device for converting a squeeze bottle having a valved brush closure to a combination golf club and golf ball cleaning system.
Figure 1A:
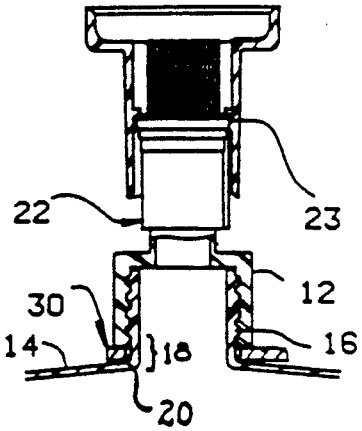
FIG. 1A is a partial section of the squeeze bottle closure and squeeze bottle neck showing the attachment of the device of the present invention to the squeeze bottle.

In its preferred embodiment the device of the present invention 10 consists of the three parts, a ring assembly 30, a combination collar-basin assembly 50 and a connecting strap assembly 70 as shown in FIG. 1. Ring assembly 30 fits under the internally threaded closure 12 on squeeze bottle 14 as shown in FIG. 1A. Once internally threaded female closure 12 is removed, ring 30 may fit over bottle neck 16 until such time as it rests in area 18 between bottle neck 16 and shoulder 20 of squeeze bottle 14. When it is desired to secure ring 30 in place, internally threaded closure 12 is threadably engaged with neck 16 of squeeze bottle 14 thereby securing ring 30 against shoulder 20 of squeeze bottle 14. If desired, ring 30 may include a plurality of semi-circular inwardly projecting portions 32 to center ring 30 on squeeze bottle neck 16. The flexible nature of these inwardly projecting portions 32 will allow for use of the device of the present invention 10 with squeeze bottles having a range of difference sized necks and allow easy installation while retaining strap 10 to bottle 14.

Figure 2:
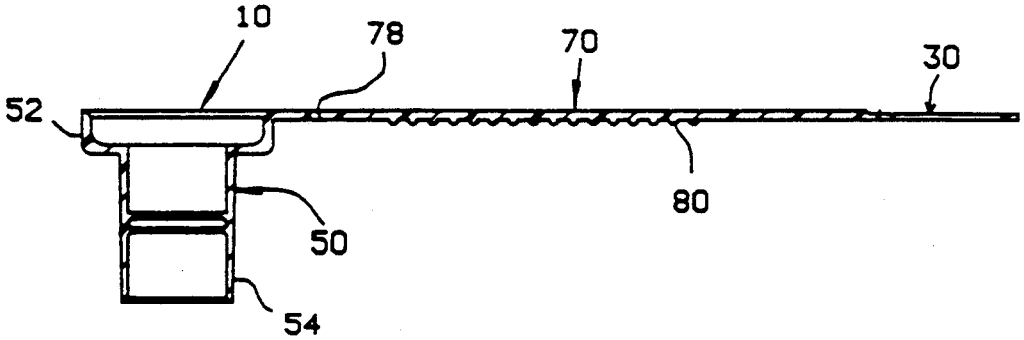
FIG. 2 is a sectional view taken along line 2—2 in FIG. 1.
Figure 2A:
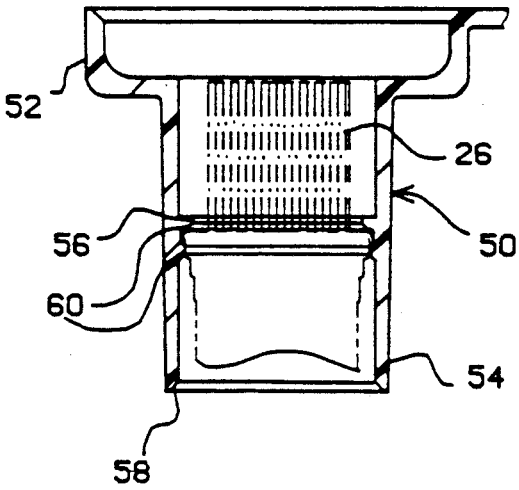
FIG. 2A is an enlargement of the combination collar and basin assembly with the location of a brush bristles imposed thereon in phantom.
Figure 4:
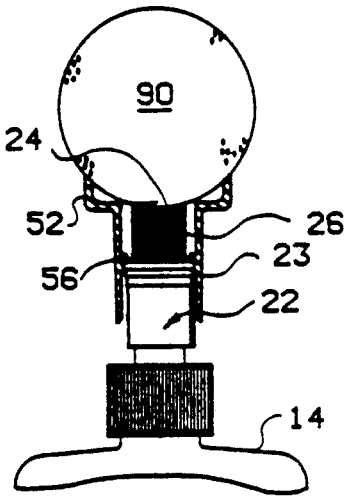
FIG. 4 is a side elevational view in partial section showing the method of cleaning a golf ball and the attachment of the device of the present invention to the squeeze bottle.

The second portion of the combination golf ball and golf club cleaning system of the present invention is combination collar and basin assembly 50 as better shown in FIGS. 2 and 2A. Because the device of the present invention 10 is used with a squeeze bottle 14 which includes a closure 12 having a valved brush assembly 22, for example, as marketed by Empire Bottle Co. of Buffalo, N.Y., it is necessary to provide a means for mounting basin 52 above valved brush assembly 22. Collar 54 performs this function. By frictional engagement between collar 54 and the outside or exterior 23 of valved brush 22, basin 52 which emanates from collar 54 is properly positioned over ends 24 of brush bristles 26 so that when golf ball 90 is rotated therein, contact is made with ends 24 (FIG. 6) of bristles 26. Such positioning is shown in FIG. 4. It is to be noted specifically that snap fit projections 56 secure collar 54 in the proper position with respect to valved brush assembly 22. To assure that bristles 26 are not bent when placed through collar 54 inwardly tapered surfaces 58 are provided at the bottom of snap fit securement means 60.

Connecting ring 30 and collar basin assembly 50 is strap 70. Strap 70 provides for convenient access to collar basin assembly 50 when the collar basin assembly 50 is removed for the cleaning of golf clubs 95 as will be explained later.

Figure 5:
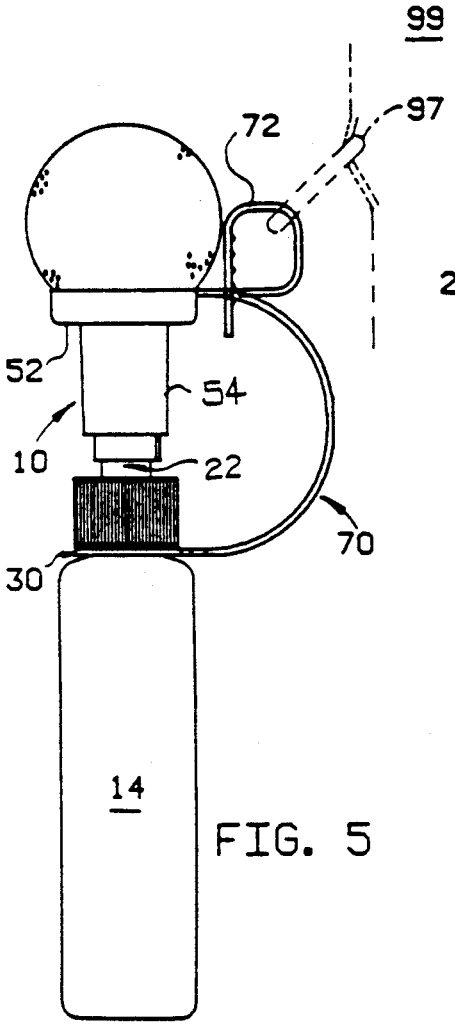
FIG. 5 is a side elevational view of the device of the present invention mounted on a squeeze bottle and connected to a ring on a golf bag.

Optionally formed within the midst of strap 70 is guard strap 72 which may be used to secure the combination golf ball and golf club cleaning system of the present invention 10 to ring 97 such as that commonly found on the side of a golf bag 99. Such securement is shown in FIG. 5. It is to be noted by reference to FIG. 1 that frangible portion 74 formed on the end 76 of the guard strap 72 is broken by the user on the initial use of guard strap 72. Guard strap 72 is then looped around through ring 97 on the side of the golf bag 99 and then through slot 78 which is formed in strap 70. A plurality of detentes 80 formed on guard strap 72 allows for adjustable securement to a golf bag.

While preferred embodiment 10 consists of three parts as previously described, it will be understood that combination collar and basin assembly 50 may be carried separately from squeeze bottle 14 without affecting the operability of the disclosed cleaning system.

Figure 3:
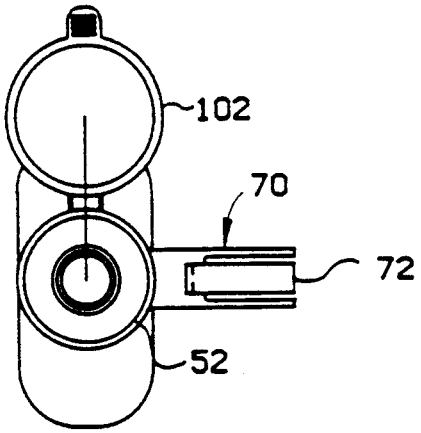
FIG. 3 is a top plan view of the device of the present invention shown attached to the squeeze bottle; shown with an optional snap-cap closure for the basin.

As may be shown in FIG. 3, an alternate embodiment of the present invention may include a closure 102 which is constructed and arranged to snap fit over basin 52 and thus protect basin 52 and brush 26 when the device 10 is not in use.

A better understanding of the construction of the disclosed combination golf ball and golf club cleaning system 10 may be obtained from a description of its operation.

OPERATION

Figure 6:
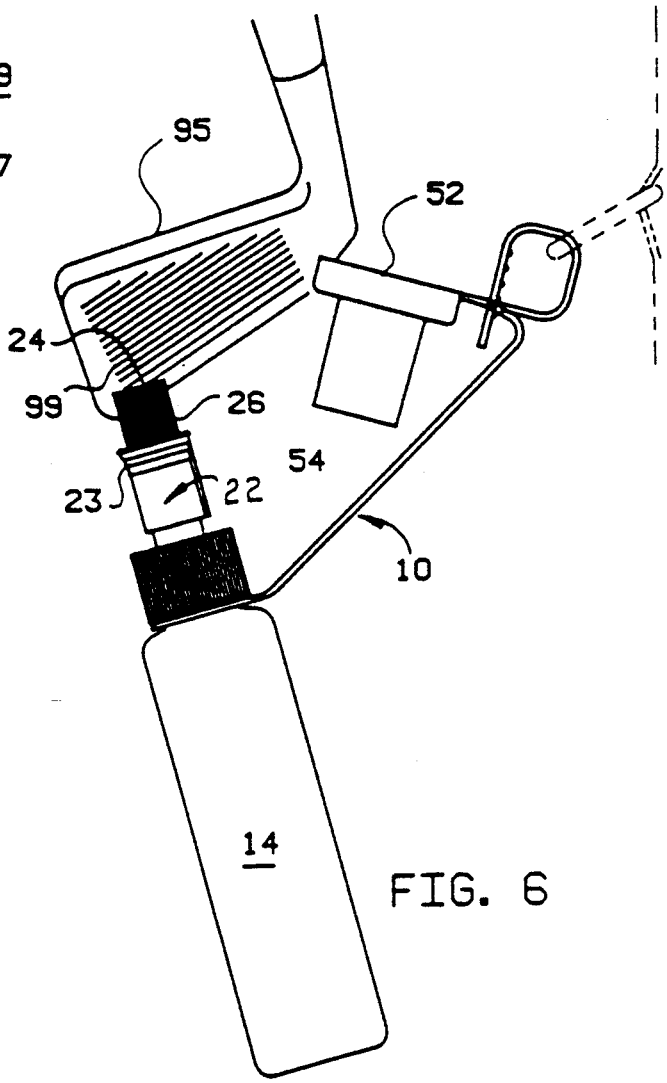
FIG. 6 is a side elevational view of the device of the present invention shown cleaning a golf club.

As may be understood by reference to FIGS. 4, 5 and 6, the combination golf ball and golf club cleaning system of the present invention 10 converts a squeeze bottle 14 with a valved brush closure assembly 22 into a device for cleaning both golf clubs 95 and golf balls 90.

Golf balls 90 are cleaned as shown in FIG. 4. Golf ball 90 is placed within basin 52 and then rotated so that its outer surface contacts ends 24 of brush bristles 26. In order to assure that liquid flows from squeeze bottle 14 into brush bristles 26, it is necessary to activate the internal valve portion (not shown) of valved brush closure assembly 22 by pulling it outwardly from squeeze bottle 14. Once bottle 14 has been squeezed, fluid flows upwardly through the internal valve and moistens brush bristles 26. By rotating golf ball 90 against moistened brush bristles 26, golf ball 90 is cleaned.

As shown in FIG. 5, device 10 may be operated whether or not attached to a golf bag.

As may be shown in FIG. 6, device 10 of the present invention may also be used to clean golf clubs 95. In order to transform the system from its golf ball cleaning configuration into one which may be used for the cleaning of golf clubs 95, it is necessary to pull collar 54 away from the outside 23 of valved brush assembly 22.

The internal valve is activated by pulling it away from squeeze bottle 14. Squeeze bottle 14 is compressed so that fluid may flow from squeeze bottle 14 through the internal valve to moisten bristles 26. Bristles 26 are then moved back and forth against grooves 99 on the surface of golf club 95 and dirt is removed therefrom.

There is now provided by the combination golf ball and golf club cleaning system 10 of the present invention a method for converting a squeeze bottle 14 having a valved brush closure assembly 22 into a device for cleaning both golf clubs 95 and golf balls 90.

While the present invention has been described by reference to its preferred embodiment, it will be understood that other embodiments of the invention may be suggested to those of ordinary skill in the art by the foregoing disclosure.

I claim:

1. A system for cleaning both a golf ball and a golf club, said system comprising:

an squeezable bottle having a necked opening, said squeezable bottle constructed and arranged for the containment of fluid;

a closure assembly constructed and arranged to engage said necked opening of said squeezable bottle;

said closure assembly having:

brush bristles emanating from the top of said closure assembly; and internal valve means for selectively providing fluid from within said squeezable bottle to moisten said brush bristles;

basin means constructed and arranged to rotatably engage and position a golf ball in rotatable contact with respect to said brush bristles, said basin means being further constructed and arranged to be removably positioned with respect to said brush bristles by frictional engagement with said closure assembly;

whereby golf balls may be cleaned when said means for positioning a golf ball in rotatable contact with said brush bristles is frictionally engaged with said closure assembly and a golf club may be cleaned when said means for positioning a golf ball is removed.

2. The system as defined in claim 1 further including means for attaching said means for positioning a golf ball in rotatable contact with said brush bristles to said necked opening.

3. A system for cleaning both a golf ball and a golf club, said system comprising:

a squeezable fluid container having a necked opening;

a closure assembly constructed and arranged to engage said necked opening of said squeezable fluid container;

said closure assembly having:

brush bristles emanating from the top of said closure assembly; and an internal valve for selectively providing fluid from within said squeezable fluid container to moisten said brush bristles;

a collar and basin assembly constructed and arranged to engage said closure assembly;

the basin portion of said collar and basin assembly constructed and arranged to rotatably engage and position a golf ball in rotatable contact with said brush bristles;

whereby, a golf ball may be cleaned when said basin and collar assembly is engaged with said closure assembly and a golf club may be cleaned when said basin and collar assembly is removed from said closure assembly.

4. The system as defined in claim 3 further including means for attaching said collar and basin assembly to said necked opening.

5. A method for cleaning of gold balls, said method comprising the steps of:

filling a squeeze bottle having a necked opening with a cleaning fluid;

closing said squeeze bottle with a closure assembly having:

brush bristles; and means for selectively apply said cleaning fluid to said brush bristles;

removably positioning a basin over said closure assembly;

rotatably positioning a golf ball against said basin; and rotating a golf ball against said brush bristles.

* * * * *